US005152430A

United States Patent [19]

Ruiberriz de Torres

[11] Patent Number: 5,152,430

[45] Date of Patent: Oct. 6, 1992

[54] WALL LIQUID SOAP, SOAP AND CEAM DISPENSER

[75] Inventor: Antonio Ruiberriz de Torres, Denia (Alicante), Spain

[73] Assignee: Mavaplast, S.L., Villajoyosa, Spain

[21] Appl. No.: 566,246

[22] Filed: Aug. 10, 1990

[30] Foreign Application Priority Data

Aug. 14, 1989 [ES] Spain ..... 8902617

[51] Int. Cl.[5] ..... B67D 5/60

[52] U.S. Cl. ..... 222/132; 222/135; 312/203

[58] Field of Search ..... 222/129, 135, 158, 180, 222/255, 325, 132; 312/203, 245, 198

[56] References Cited

U.S. PATENT DOCUMENTS

| | | | |
|---|---|---|---|
| 3,990,611 | 11/1976 | Sojka | 222/180 X |
| 4,548,340 | 10/1985 | Messer | 222/135 |
| 4,615,476 | 10/1986 | Hobbs et al. | 222/180 X |
| 4,913,319 | 4/1990 | Root | 222/135 |

*Primary Examiner*—Michael S. Huppert
*Assistant Examiner*—Gregory L. Huson
*Attorney, Agent, or Firm*—Darby & Darby

[57] ABSTRACT

A liquid dispenser is formed from a first and second plurality of containers with the first containers having a smaller height than the second containers. The rear surfaces of the containers are formed from a common back plate. A shelf is provided below the first containers in a space defined by the bottom of the first containers, the shelf, the sides of the second containers, and the common back plate.

1 Claim, 1 Drawing Sheet

WALL LIQUID SOAP, SOAP AND CEAM DISPENSER

OBJECT OF THE INVENTION

The object of the invention refers to a liquid soap, soap and cream dispenser usable in public bathrooms as well as private ones, which permits having different products and complementary objects for personal grooming at the user's disposal.

BACKGROUND OF THE INVENTION

Shelves and closets upon which products in individual containers are placed are known in the prior art.

The inconveniences of this distribution for use of the products derive from the diversity of the goods used for the personal grooming for each user.

Aside from this, large spaces may be needed to place all the containers and jars, as well as utensils (combs, sponges, brushes and the like.)

DESCRIPTION OF THE INVENTION

The wall dispenser that is described constitutes a modular element which forms a longitudinal body divided transversally into several compartments or containers. Each one of the containers is provided with an inlet and a respective cover. The cover is replaced when the dispenser is in use with a push button with a suction and force pump which is individually located in the inlet of each compartment. This permits removal of a dose of product contained in each compartment.

As a part of the dispenser structure of the module dispenser a shelf-like gridiron or rack for placement of typical grooming utensils, has been provided for. This rack or shelf will be preferably situated in a separate space defined below the central compartments to maintain the homogeneity of the unit.

However, it is foreseen that this rack or gridiron complements the module dispenser by extending therefrom.

With this arrangement one can have access to several totally independent products.

BRIEF DESCRIPTION OF THE DRAWINGS

The attached ones show the dispenser in two positions.

BRIEF DESCRIPTION OF A PREFERRED EMBODIMENT

Figure 1:
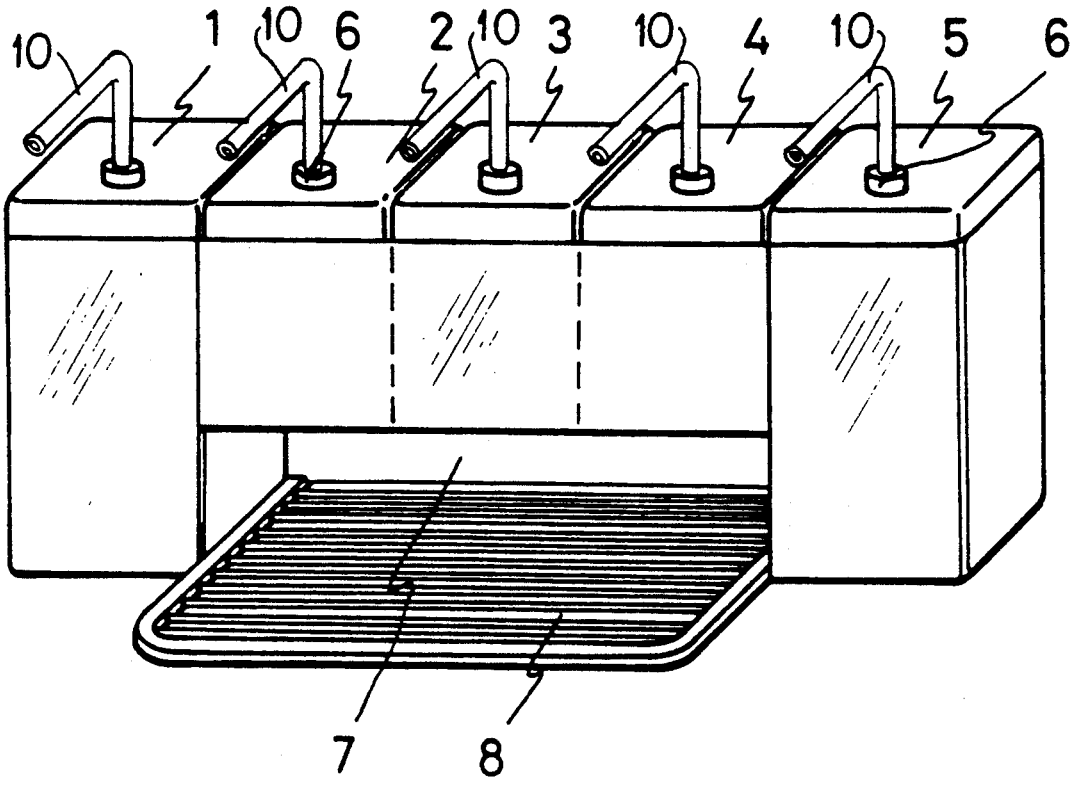
FIG. 1.- It is a perspective view of the dispenser from a top front view.
Figure 2:
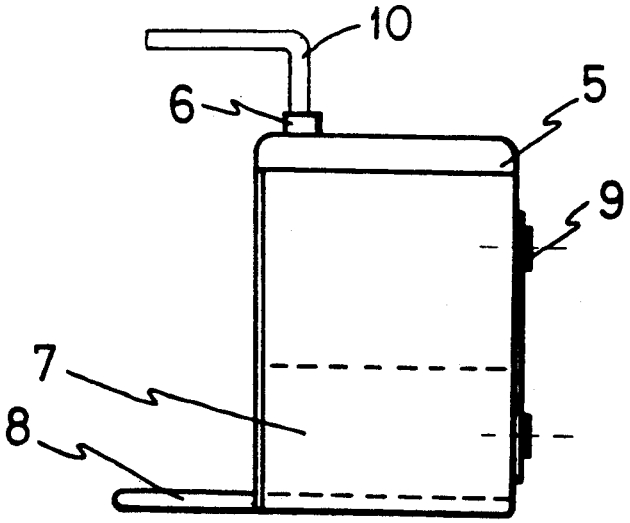
FIG. 2.- It is a side profile.

According to the cited drawings one can see that the dispenser comprises a series of containers (1), (2), (3), (4) and (5), whose number is variable, each one of which is independent, the combination forming on the whole a modular element. Each container has a perforation (6) where a suction and force device 10 will be installed for the dosification of the respective products.

It has been provided in one embodiment, that the center containers, are higher than the ends ones, for the purpose of obtaining a free space (7) of access to a rack (8) forming a shelf for placement of grooming accessories.

The modular unit is provided in the rear part with means (9) for fastening same to the wall.

The number, size and general shape of the modular unit will be variable, always keeping the basic construction of compartments and rack shelf.

I claim:

1. A liquid soap and cream dispenser which comprises:

a flat back plate;

a plurality of first rectangular containers for receiving a liquid or cream extending from said back plate, said first containers positioned adjacent one another in a row and said first containers having top, bottom and front surfaces;

a plurality of second rectangular containers for receiving a liquid or cream extending from said back plate, at least one of said second containers positioned on each end of said row of first containers and said second containers having top, bottom and front surfaces;

said first containers having a smaller height than said second containers, said first and second container top surfaces being coplanar; and a shelf positioned below said first containers, the bottom of said shelf being coplanar with said second container bottom surfaces and said shelf protruding frontwardly of said containers;

said back plate forming the rear surfaces of each of said containers and extending from said first container bottom surfaces to said bottom surface of said shelf, thereby enclosing a space between said shelf, said first container bottom surfaces, and the side surfaces of said second containers;

each of said containers having an inlet positioned in their top surfaces; and means for dispensing the liquid from said first and second containers coupled to said inlets of said containers.

* * * * *